US011448231B2

(12) United States Patent
Hong

(10) Patent No.: US 11,448,231 B2
(45) Date of Patent: Sep. 20, 2022

(54) COOLING FAN MODULE

(71) Applicant: Brose Fahrzeugteile SE & Co. Kommanditgesellschaft, Würzburg, Würzburg (DE)

(72) Inventor: Tao Hong, Farmington Hills, MI (US)

(73) Assignee: Brose Fahrzeugteile SE & Co. Kommanditgesellschaft, Würzburg, Würzburg (DE)

( * ) Notice: Subject to any disclaimer, the term of this patent is extended or adjusted under 35 U.S.C. 154(b) by 0 days.

(21) Appl. No.: 16/934,368

(22) Filed: Jul. 21, 2020

(65) Prior Publication Data

US 2022/0025899 A1 Jan. 27, 2022

(51) Int. Cl.

| | |
|---|---|
| ***F04D 29/32*** | (2006.01) |
| ***F04D 29/38*** | (2006.01) |
| *F04D 19/00* | (2006.01) |
| *F01P 5/06* | (2006.01) |

(52) U.S. Cl.

CPC ..... *F04D 29/326* (2013.01); *F04D 29/384* (2013.01); *F01P 5/06* (2013.01); *F01P 2070/50* (2013.01); *F04D 19/002* (2013.01); *F04D 29/329* (2013.01)

(58) Field of Classification Search

CPC .... F04D 29/326; F04D 29/384; F04D 29/329; F04D 19/002; F01P 5/06; F01P 2070/50

See application file for complete search history.

(56) References Cited

U.S. PATENT DOCUMENTS

| | | | | |
|---|---|---|---|---|
| 3,680,977 | A * | 8/1972 | Rabouyt | B64C 11/001 415/173.6 |
| 4,802,771 | A * | 2/1989 | Weetman | B01F 7/00358 366/270 |
| 6,024,537 | A * | 2/2000 | Moreau | F04D 29/326 416/169 A |
| 6,517,315 | B2 | 2/2003 | Belady | |
| 6,626,640 | B2 * | 9/2003 | Ivanovic | F04D 29/384 415/142 |
| 7,189,061 | B2 * | 3/2007 | Hong | F04D 29/666 416/145 |
| 7,244,110 | B2 * | 7/2007 | Hong | F04D 25/082 310/62 |
| 7,478,993 | B2 * | 1/2009 | Hong | F04D 29/547 415/211.2 |
| 8,491,270 | B2 * | 7/2013 | Eguchi | F04D 29/681 416/235 |

(Continued)

FOREIGN PATENT DOCUMENTS

| | | |
|---|---|---|
| DE | 2405050 A1 | 8/1975 |
| EP | 3203061 A | 8/2017 |

*Primary Examiner* — Brian P Wolcott
*Assistant Examiner* — Joshua R Beebe
(74) *Attorney, Agent, or Firm* — Brooks Kushman P.C.

(57) ABSTRACT

The cooling fan module may include a fan assembly and a fan shroud. The fan shroud of the cooling fan module may include a first sidewall that may extend in a radial direction and define an opening. The fan assembly may include a hub disposed within the opening, a blade extending from the hub to a distal end that may include a first side and a second side converging to form a first leading edge with respect to the rotational direction. The fan assembly may include a winglet that may include a first fin, extending in the axial direction from the distal end of the blade and a second fin extending in the radial direction.

17 Claims, 7 Drawing Sheets

(56) References Cited

U.S. PATENT DOCUMENTS

| | | | | |
|---|---|---|---|---|
| 8,550,782 | B2 * | 10/2013 | Hoskins | F04D 29/384 416/191 |
| 8,568,095 | B2 | 10/2013 | Bushnell | |
| 9,909,485 | B2 | 3/2018 | Hong | |
| 10,190,601 | B2 * | 1/2019 | Dygert | F04D 29/164 |
| 10,844,770 | B2 * | 11/2020 | Hong | B60K 11/02 |
| 2019/0353083 | A1 | 11/2019 | Wichers et al. | |

* cited by examiner

COOLING FAN MODULE

TECHNICAL FIELD

The present disclosure relates to a cooling fan assembly that may be used in motor vehicles or in other applications such as cooling fan for a home heating and cooling system.

BACKGROUND

Vehicles often include various components that are cooled by a heat exchanger, such as a radiator. Heated air may be drawn or moved through the radiator by a cooling fan module. Cooling fan modules may include a powered fan that is housed within a frame and operable to move drawn air from an upstream side of the frame to a downstream side of the frame. Air drawn to the downstream side of the frame recirculates to the upstream side through gap between fan blade tip and frame opening, thus leading to in efficiencies.

SUMMARY

According to one or more embodiments, a cooling fan module is provided. The cooling fan module may include a fan assembly and a fan shroud. The fan shroud of the cooling fan module may include a first sidewall that may extend in a radial direction and define an opening. The fan assembly may include a hub disposed within the opening, a blade or a number of blades, each extending from the hub to a distal end that may include a first side and a second side converging to form a first leading edge with respect to the rotational direction. The fan assembly may include a winglet that may include a first fin, extending in the axial direction from the distal end of the blade and a second fin extending in the radial direction. The first and second fins may each form surfaces that rotate about the rotational axis of the fan. The first fin may extend along a segment of a first circle that extends between the distal ends of each of the blades. The second fin may extend from the first fin to a segment of a second circle that may have a larger diameter than the first circle.

In one or more embodiments, portions of the first fin, extending in an axial direction from the distal end, may be disposed on the first side and the second side of the blade. The first fin extending in the axial direction may form a second leading edge. In one or more embodiments, the second fin includes a third leading edge and a trailing edge, each arranged with respect to the rotational direction, and a distal edge extending therebetween. The third leading edge and the trailing edge may extend along a first angle and a second angle, respectively. The first angle and the second angle may each be oblique to a radial line extending from rotational axis. The trailing edge may extend along the radial line. In one or more embodiments, the first angle may range between 0 degrees and 70 degrees.

In one or more embodiments, the first fin may define a second leading edge and a portion of the first leading edge disposed at the distal end may extend beyond the second leading edge. The portion may have a substantially planar shape and may not be curved as the rest of the first leading edge. The portion of the first leading edge disposed at the distal end may define a third angle that may be substantially equal to 90 degree. In one or more embodiments, the third angle is based on requirements for tooling. In one or more embodiments, the second leading edge of the first fin may define a fourth angle that may be equal to or greater than the first angle.

The first fin may have a first corner and a second corner, the second corner may be positioned substantially diagonal to the first corner and the distal end of the blade may extend between the first corner and the second corner.

According to another embodiment, a cooling fan module including a frame provided with a first sidewall extending in a radial direction and defining a central opening, and a fan assembly disposed within the central opening is provided. The fan assembly may include a hub, a blade extending from the hub to a distal end and including a first side and a second side converging to form a first leading edge, and a winglet including a first fin extending in the axial direction from the distal end and a second fin extending in the radial direction. In one or more embodiments, portions of the first fin extending in the axial direction from the distal end are disposed on the first side and the second side of the blade.

In one or more embodiments, the frame may be provided with a second sidewall forming an inner periphery of the central opening and axially extending from the first sidewall. The first fin may at least partially overlap the second sidewall. The winglet may include a medial portion extending between the first fin and the second fin. And the medial portion may be concave with respect to an inner periphery of the central opening. The medial portion and the first fin may each be axially and/or radially spaced apart from the first sidewall. To further reduce blade tip recirculating flow, the frame may be provided with a third sidewall extending radially from the downstream end of the second sidewall towards fan axis, which end at about the same radius as blade distal end. There is a clearance in axial direction between winglet and the third sidewall about the same dimension as the clearance between winglet and the second sidewall.

According to yet another embodiment, a fan assembly for use in a vehicle cooling fan module, is provided. The fan assembly may be rotatable in a rotational direction about a rotational axis. The cooling fan module may include a fan shroud provided with a first sidewall extending in a radial direction defining an opening. The cooling fan assembly may also include a hub disposed within the opening, a blade extending from the hub to a distal end which includes a first side and a second side converging to form a first leading edge with respect to the rotational direction. Moreover, the fan assembly may have a winglet having a first fin, extending in the axial direction and a second fin extending in the radial direction. The first fin may include a second leading edge with respect to the rotational direction and a portion of the first leading edge disposed at the distal end of the blade extends beyond the second leading edge of the first fin. In one or more embodiments, the portion may lie within a common surface of the first fin.

DETAILED DESCRIPTION

Figure 1:
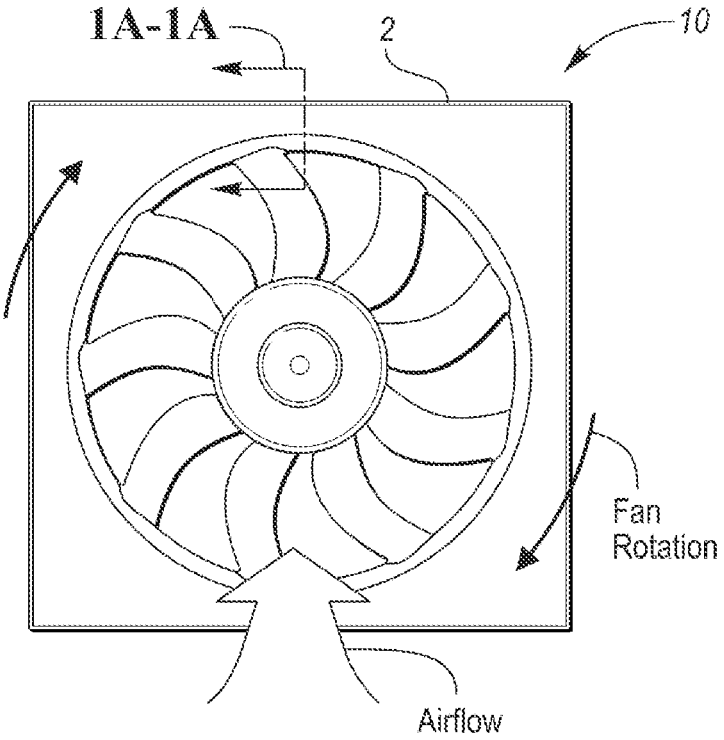
FIG. 1 (PRIOR ART)
FIG. 1 is a plan view of an exemplary prior-art cooling fan module.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Vehicles may include one or more cooling fan modules to cool heat-generating components, such as an engine, battery, transmission, radiator, or electric motor. An exemplary cooling fan module is described in U.S. Pat. No. 9,909,485 and is hereby incorporated by reference. Another exemplary cooling fan module is described in U.S. Patent Publication No. 2019/0353083 A1 (the '083 application) and is hereby incorporated by reference. The '083 application describes forward and rearward swept blade elements. Cooling fan modules may include a fan assembly disposed within an opening of a fan shroud. When powered the motor rotates the fan to create an airflow to displace heated air away from the radiator. The side of the cooling fan module disposed closest to the radiator may be referred to as the upstream side and the side disposed further away from the radiator may be referred to as the downstream side.

Pressure downstream from the fan may be higher than pressure on the upstream side of the fan. This pressure difference may drive recirculating airflow from the downstream side back to the upstream side through a space that may be referred to as a clearance gap between the fan and the opening defined by the fan shroud. This recirculating airflow may be drawn across distal ends or tips of the fan blades, thus decreasing efficiency and leading to unwanted noise.

The clearance gap between the blade tip and the shroud opening needs to be large enough to allow for variation caused by manufacturing tolerances and deformation of the fan as the fan rotates. A relatively large clearance gap may result in increased tip recirculating flow that may cause reduced fan efficiency and increased fan noise. Known cooling fan modules include a fan ring or band that extends between each of the fan blades. These fan rings or band may mitigate blade deformation and reduce tip recirculation loss. Other cooling fan modules do not include a ring or a band and as such, they may suffer from relatively large recirculating loss and have an associated low operating efficiency. Operating efficiency may refer to the amount of power required for a certain air flow rate against certain pressure difference.

The present disclosure attempts to resolve the above-mentioned problems. For example, the present disclosure describes a bandless fan provided with a number of winglets disposed at a distal end of each of the fan blades. The cooling fan modules provided in the present disclosure may increase or maximize efficiency of the cooling fan modules by minimizing recirculation leakage between the fan assembly and the shroud, which also lead to reduced fan noise. Eliminating the band or fan ring may reduce the amount of material required to produce the fan, decrease the weight and mass moment of inertia of the fan which lead to increase of the natural frequency of the fan.

In the following discussion of the figures, a polar coordinate system is utilized. An axial direction extends along an axis of rotation of the fan assembly. A radial direction extends orthogonal to the axial direction from the axis of rotation towards a periphery of the frame of the cooling fan module.

The term orthogonal means one or more surfaces or lines intersect at a right angle or are arranged at a right angle. The term planar means a surface is flat and lies along a surface.

The term "leading edge" may be used herein to describe the foremost edge of a fan blade, whose cross sections are aerofoils (i.e., airfoils), with respect to the rational direction. The term "trailing edge" may be used herein to describe the rear most edge of a fan blade, whose cross sections are aerofoils (i.e., airfoils), with respect to the rotational direction.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1A:
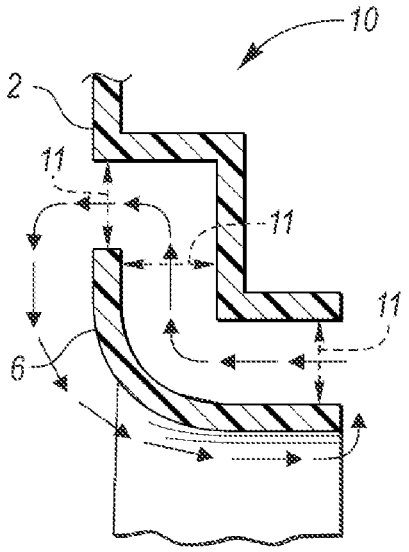
FIG. 1A (PRIOR ART)
FIG. 1A is a cross-sectional view taken along the lines 1A-1A in FIG. 1.

FIG. 1 illustrates a front view of a prior art cooling fan module 10 and FIG. 1A illustrates a cross-section of the same taken along the lines 1A-1A. The prior art cooling fan module 10 includes a fan assembly that includes fan blades that are connected to one another by a fan ring 6. The prior art cooling fan module 10 may include a frame 2 that includes a wall that is spaced apart from the fan ring 6 by an axial and/or radial distance 11.

Figure 1B:
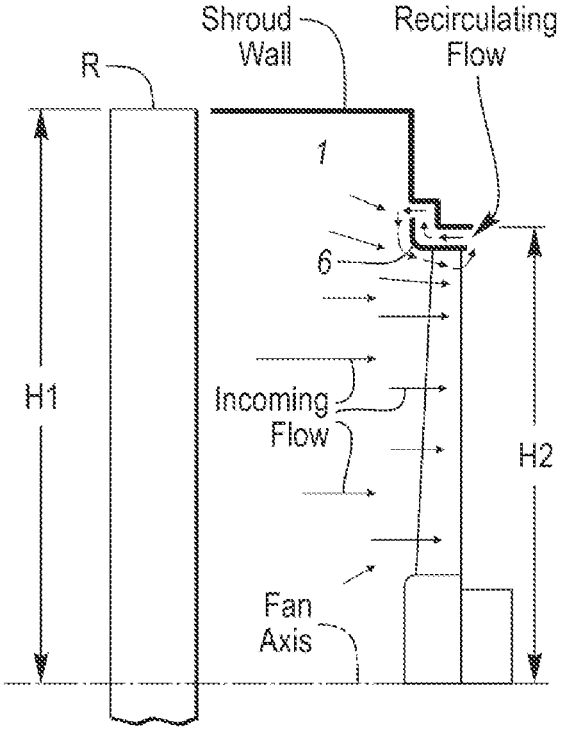
FIG. 1B (PRIOR ART)
FIG. 1B is an exemplary schematic view of a prior art cooling fan module.

FIG. 1B depicts a side view illustrating airflow between a radiator R and the prior art cooling fan module 10. During operation, the cooling fan creates a low-pressure zone between the radiator R and the cooling fan module 10, which draws airflow through the radiator. As pressure on the downstream side of the fan is higher than upstream side of the fan, the airflow may recirculate back through the tip gap (tip clearance) between the fan ring and shroud opening barrel. The recirculating air may lead to a decrease in efficiency and increased noise.

Referring generally to the Figures, a cooling fan module 100 is provided. The cooling fan module 100 may include a fan assembly 102 and a fan shroud 104. The fan assembly 102 may rotate in a rotational direction RD about a rotational axis A. The fan shroud 104 may be provided with a first sidewall 106 that may extend in a radial direction and that may define an opening 108. The fan assembly 102 may include a hub 110 that may be substantially disposed within the opening 108 and one or more blades 112 that may extend from the hub 110 to a distal end 114. A winglet 116 may extend from the distal end 114 of each of the blades 112.

The fan assembly 102 provided with a winglet 116 may weigh less and have a higher natural frequency than known banded fans such as the prior-art fan and prior-art fan ring 6 described above. Experiments have shown that the winglet 116 may increase the natural frequency, such as a first order natural frequency, of the fan assembly 102 by at least 20 Hz as compared to fans of similar size, having an overall diameter ranging between 500 mm and 600 mm. Experiments and simulations have also shown that the fan assembly 102 provided with the winglets 116 is collectively lighter and more efficient than known banded fans. As an example, the fan assembly 102 has shown at least a 3% increase in operating efficiency as compared to a similarly sized banded fan.

Each of the blades 112 may include a first side 118 and a second side 120 that may converge to form a first leading edge 122. The first side 118 may face towards a pressure side or downstream side of the cooling fan module 100 and the second side 120 may face towards the upstream side of the cooling fan module 100.

One or more of the winglets 116 may include a first fin 124 that may extend in the axial direction from the distal end 114, and a second fin 126 that may extend in the radial direction from the distal end 114. In one or more embodiments, portions of the first fin 124 may be disposed on the first side 118 and the second side 120 of one or more of the blades 112. The first fin 124 may define a second leading edge 128 and a portion 130 of the first leading edge 122, disposed at the distal end 114, may extend beyond the second leading edge 128. In other words, the first fin 124 may stop short and not extend over the entire distal end 114 of the blade 112 so that the portion 130 of the first leading edge 122 at the distal end 114 extends beyond the first fin 124. The portion 130 may have a substantially planar shape and may not be curved as the rest of the first leading edge 122. This configuration may prevent trapping of air that may lead to a relatively high air pressure point at or near where the first fin 124 meets the distal end 114 at the first leading edge 122. A high pressure point or points may lead to airflow separation that may increase noise level and fan torque and may decrease the efficiency of the fan assembly 102.

The second fin 126 may include a third leading edge 132, a trailing edge 134, and a distal edge portion 136 extend therebetween. The third leading edge 132 and the trailing edge 134 may extend along a first angle A1 and a second angle A2, respectively. The first angle A1 and the second angle A2 may each be oblique to a radial line R extending from rotational axis A. The trailing edge 134 may extend along the radial line RL2. The portion 130 of the first leading edge 122 disposed at the distal end 114 may define a third angle A3 that may be substantially perpendicular to the radial line RL1. The first fin 124 having the second leading edge 128 may define a fourth angle A4 that may be equal to or greater than the first angle A1.

The description of the leading edges of the winglet 116 and fan assembly 102 illustrated in FIG. 2 through FIG. 7 are for backward swept fans but may be applied to forward swept fans.

The first fin 124 may include a first corner 138 and a second corner 140 that may be positioned substantially diagonal to the first corner 138. In one or more embodiments, the distal end 114 of the blade 112 may extend between the first corner 138 and the second corner 140.

Figure 2:
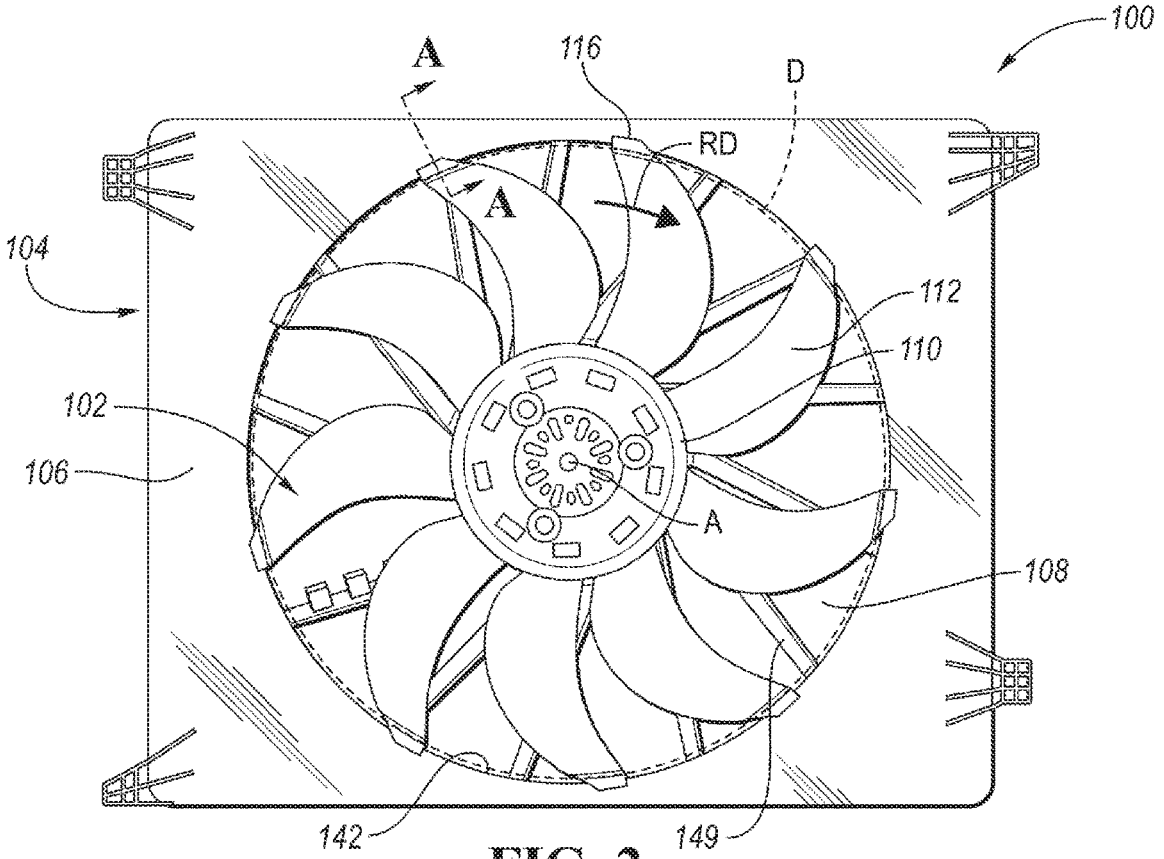
FIG. 2 is a plan view of an exemplary cooling fan module.

Referring specifically to FIG. 2, a plan-view of the cooling fan module 100 is illustrated. The cooling fan module 100 includes the fan assembly 102 and the fan shroud 104. The fan shroud 104 is provided with a first sidewall 106 extending in a radial direction and defining an opening 108 that may be centrally located with respect to an outer periphery of the fan shroud 104. The cooling fan module 100 includes the fan assembly 102 provided with a motor mounted in the opening 108 and may be supported by struts 149, and a fan hub 108 may be mounted to a shaft of the motor. The winglet 116 may include a bottom portion that extends from the distal end 114 of the blade 112. The bottom portion may be formed by the first fin 124 or the medial portion 144 (FIG. 2A) and the bottom portion may extend along a constant radius or diameter D. The diameter D may be a diameter centered about the rotational axis A. In one or more embodiments, the fan shroud 104 may include a second sidewall 142 that may form an inner periphery of the central opening 108. As an example, the second sidewall 142 may axially extend from the first sidewall 106 and the first fin 124 may at least partially overlap the second sidewall 142 in the axial direction.

The fan shroud 104 according to one or more embodiments of this disclosure, may be a frame in which the fan assembly 102 is mounted and is arranged and/or secured on or in the vicinity of the cooler. The fan shroud 104 may be formed of a plastic material, for example polyethylene, polyamide, nylon, glass filled or a combination therefrom. In other embodiments, the fan shroud 104 may be formed of a metal material, for example iron, steel, aluminum, magnesium or the like or a combination thereof. In one or more embodiments, the fan shroud 104, a motor mount ring (not illustrated), and the struts may be formed as a single-piece of plastic that may be formed by injection molding. As an example, the fan shroud 104 may have more than one opening 108, hub 110, or motor. Such an arrangement may be used when one fan assembly is not enough to provide sufficient airflow to displace the generated heat. In one or more embodiments, the motor mounted in the motor mounting ring and supported by the struts is an electric motor. Additionally, the fan shroud 104 may include at least one closable opening such as a flap. One or more closable openings may be provided to allow more airflow in certain ram air conditions.

Figure 2A:
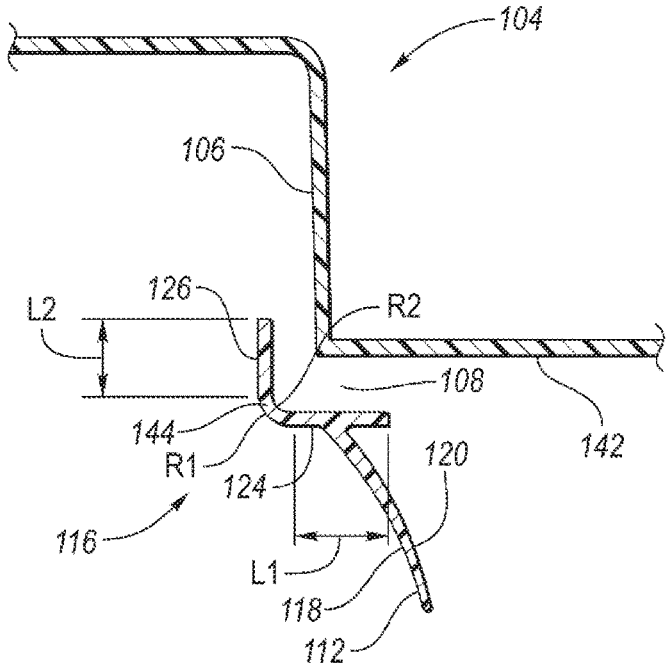
FIG. 2A is a cross-sectional view taken along the lines A-A in FIG. 2.

FIG. 2A illustrates a partial cross-sectional view taken along the lines A-A in FIG. 2. As described above, the fan shroud 104 includes a first sidewall 106 extending in the radial direction and defining the opening 108. As an example, an inner periphery of the opening 108 may be defined by the second sidewall 142 that extends in the axial direction. The winglet 116 may include a medial portion 144 extending between the first fin 124 and the second fin 126. The medial portion 144 may be concave with respect to the inner periphery of the opening 108 such as a point of intersection between the first sidewall 106 and the second sidewall 142. An outer surface of the medial portion 144 may define an outer radius R1 and an inner surface of the medial portion 144 may define an inner radius R2. As an example, the inner radius R2 may be less than or tighter than the outer radius R1 and range between 0.5 mm and 5 mm.

The first fin 124 and the second fin 126 may each extend so that each are substantially parallel to the first sidewall 106 and the second sidewall 142, respectively. The first fin 124 may be aligned radially with respect to the first sidewall 106 so that the first fin 124 substantially overlaps the first sidewall 106. As an example, the first fin 124 may have a length L1 that may overlap the first sidewall, or the second sidewall 142, or both by at least 4 mm. The second fin 126 may have a length L2 so that at least a portion of the second fin 126 axially overlaps the first sidewall 106. The second fin 126 may overlap the first sidewall by at least 2 mm.

The length L1 may be a function of the slope of the one or more blades 112 so that the length L1 is substantially equal to an axial depth of the blade. In general, the length L1 may be sufficiently long to overlap the first sidewall 106 to block and/or reduce tip recirculating flow. As an example, the length L1 may range between 10 mm and 20 mm. In general, the length L2 extending in the radial direction need to be sufficient enough to cover the gap between the fin and shroud barrel to direct the recirculating flow in the radial direction to reduce this flow.

In one or more embodiments, the winglet 116 is plastic for example polyethylene, polyamide, nylon, glass filled or a combination therefrom. In other embodiments, the winglet 116 is made of a metal material, for example iron, steel, aluminum, magnesium or the like or a combination therefrom. In one or more embodiments, the hub 110, the blades 112, the winglet 116, or any combination therefrom are formed as a single-piece plastic injection mold part. As another example, the first fin 124 may be made out of a different material than the second fin 126.

Figure 2B:
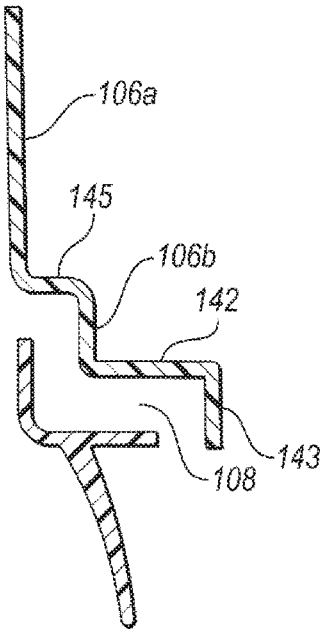
FIG. 2B is a cross-sectional view of another exemplary cooling fan module.

FIG. 2B illustrates another partial cross-sectional view of another fan shroud 104. As an example, the fan shroud 104 may include a sidewall 106 that includes a first section 106*a* and a second section 106*b* that are axially offset from one another. The first section 106*a* and the second section 106*b* may be connected by an axially extending wall 145. A third sidewall 143 may extend radially inward from a distal end of the second sidewall 142. In one or more embodiments, the second fin may be aligned radially with the first section 106*a* and the first fin 124 may be axially spaced apart from the third sidewall 143. As an example, a distal end of the third sidewall 143 may be axially aligned with the first fin 124. In the axial direction, the third sidewall may block a majority of the opening of the gap between the winglet 116 and the inner periphery of the central opening 108. As such, as the air enters the gap, the recirculating flow must turn approximately 90° to change from the radial direction to the axial direction. Similarly, the extending wall 145 may also force recirculating flow to make a 90° turn from radial direction to axial direction. Forcing the recirculating air to make multiple relatively sharp turns may reduce recirculating flow loss.

Figure 3:
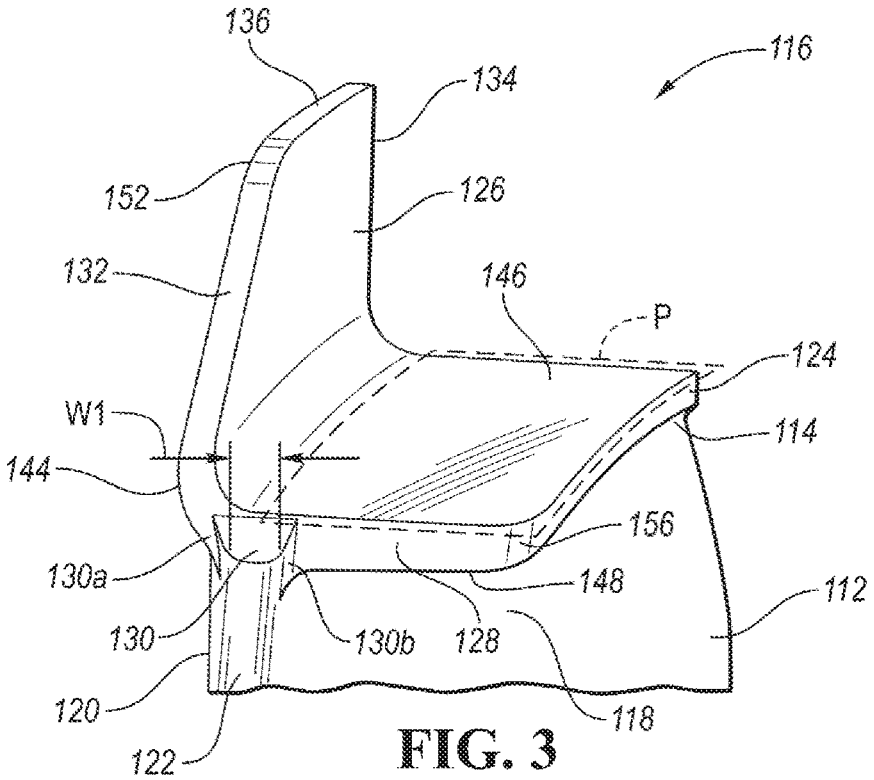
FIG. 3 is a partial-top-perspective view of an exemplary fan blade and winglet.

FIG. 3 illustrates a perspective view of an exemplary winglet 116 disposed on the distal end 114 of the backward swept fan blade 112. As illustrated, the fan blade 112 may rotate in a direction that is substantially towards one viewing FIG. 3. The fan blade 112 includes the first side 118 and the second side 120 that may converge to form the first leading edge 122. As illustrated, the first fin 124 extends from the first and second sides 118, 120 of the blade 112. A forward most portion of the first fin 124 may define the second leading edge 128. The second leading edge 128 may be formed by an angled portion extending between a bottom surface 148 and a top surface 146 of the first fin 124. The second leading edge 128 may extend axially between a curved corner portion 150 and the planar exposed portion 130. Alternatively, the curved corner portion 150 may be part of the second leading edge 128.

A portion of the second leading edge 128, such as where the bottom surface 148 and the second leading edge 128 converge may include one or more curved portions. The curved portions may be required so that the winglet 116 and fan blade may be formed by injection molding. As an example, the radii may range between 20% and 35% of the thickness of the winglet first fin 124.

In one or more embodiments, the first fin 124 and the second fin 126 may each have a thickness that corresponds to a thickness of the blade 112. For example, if the blade 112 has a thickness of 4 mm, the first fin 124, or the second fin 126, or both may have a thickness of 1 mm. If the blade 112 has a thickness of 6 mm, the first fin 124, or the second fin 126, or both may have a thickness of 1.5 mm. The thickness of the blades and the fins may vary depending on the overall size of the fan and the relative stiffness of the material used to form the blades 112 and winglets 116. The thickness of the medial portion 144 may be substantially equal to the thickness of each of the fins 124, 126.

The medial portion 144 may extend between the first fin 124 and the second fin 126. A forward most portion of the second fin 126 and the medial portion 144 may form the third leading edge 132. The third leading edge 132 may extend to the distal edge portion 136 and the distal edge portion 136 may terminate at the trailing edge 134. The distal edge portion 136 may be substantially parallel to first fin 124. As an example, a distal curved portion 152 may extend between the distal edge portion 136 and the third leading edge 132. The distal curved portion 152 may be curved to prevent airflow separation.

As described above, a portion 130 of the first leading edge 122 at the distal end 114 may be provided with a substantially planar shape. The second leading edge 128 may converge or extend to the portion 130. In one or more embodiments, the portion 130 may lie within a surface P that may be common with the first fin. As an example, the common surface P may be defined by the top surface 146 and the bottom surface 148 of the first fin 124. The common surface P is represented by the rectangular box formed by dashed lines in FIG. 3. The common surface P may be formed by a partial cylindrical surface that the first fin extends along. In one or more embodiments, the common surface is curved to correspond to the curvature of the first fin 124. As an example, the portion of the cylindrical surface may be defined by the dashed line D shown in FIG. 6. The portion 130 may define a width W1 that may be a function of a thickness of the blade 112. The portion 130 may be referred to as an uncovered nose and the uncovered nose may be configured to reduce airflow separation and noise. The portion 130 may include a pair of connecting portions 130*a*, 130*b*, that extend from each side 118, 120 of the blade 122 to the substantially planar portion 130 and the second and third leading edges 128, 132.

Figure 4:
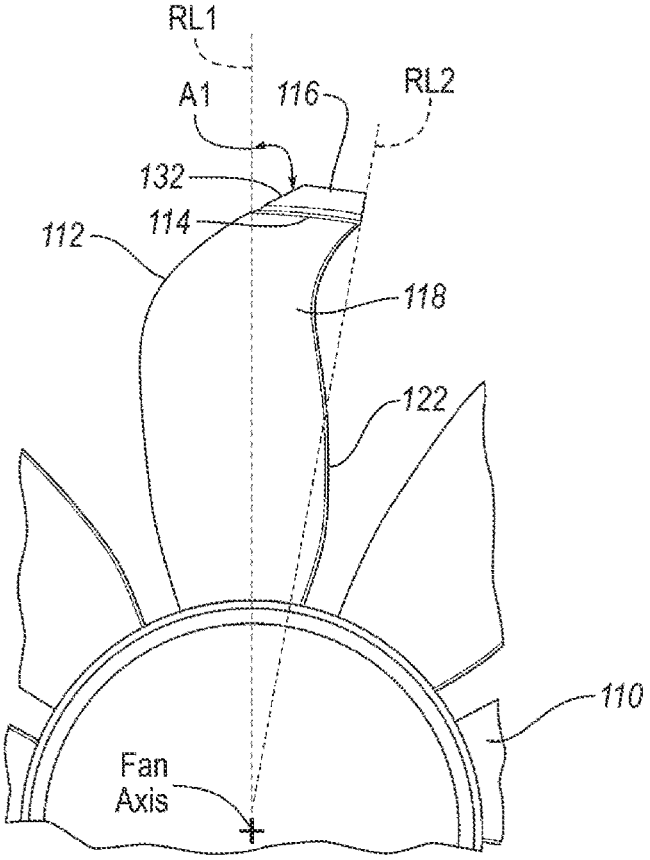
FIG. 4 is a partial plan view of the exemplary fan blade and winglet.
Figure 5:
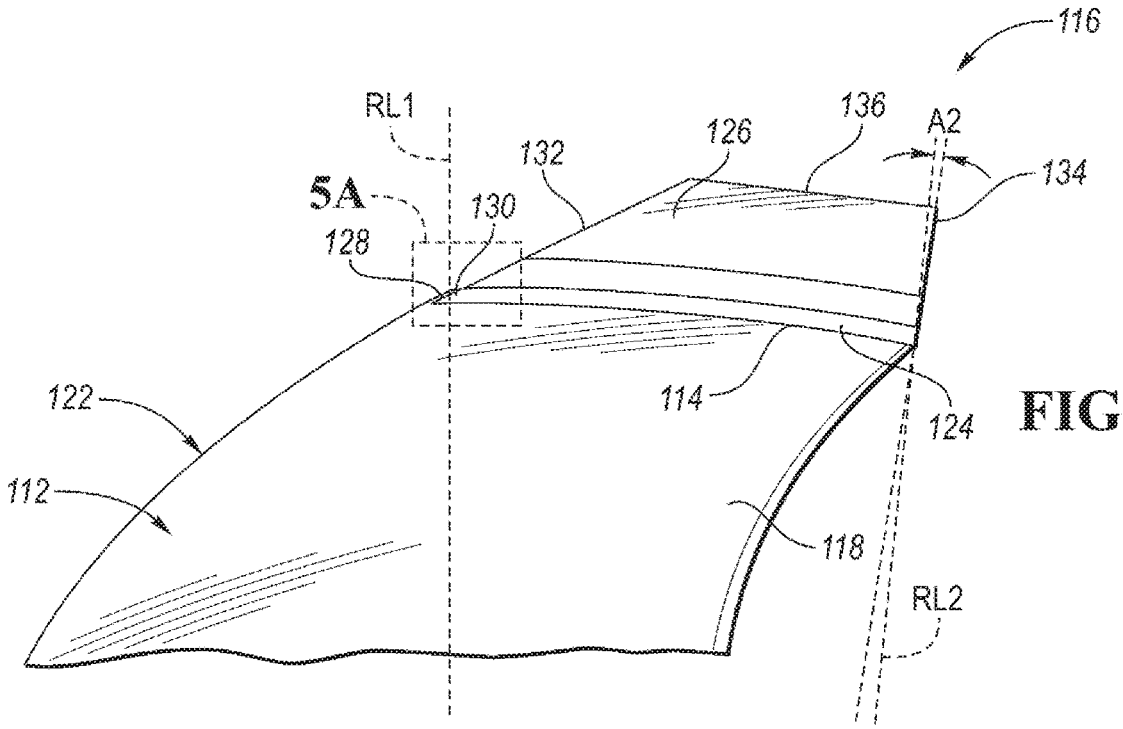
FIG. 5 is a detailed view of a portion of the exemplary fan blade and winglet illustrated in FIG. 4.
Figure 5A:
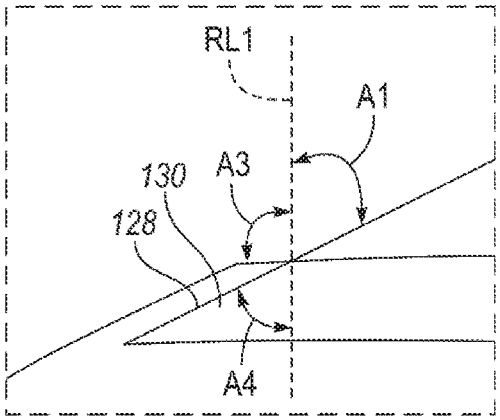
FIG. 5A is another detailed view taken along the lines 5A in FIG. 5.

Referring specifically to FIG. 4 and FIG. 5, a partial plan-view of the fan assembly 102, and a detailed view of a portion of FIG. 4, respectively, are illustrated. FIG. 5A is another detailed view taken along the lines 5A in FIG. 5. The fan assembly 102 includes the blade 112 that extends from the hub 110 to the distal end 114. The blade may include a first side 118 and a second side 120 (FIG. 7) that may converge to form a first leading edge 122 with respect to the rotational direction D (FIG. 2). The one or more blades 112 extending from the hub 110 may be straight, forward or backward sweep.

The winglet 116 may be arranged with respect to one or more radial lines extending from the axis of rotation A. As an example, the first radial line RL1 may extend to a forward most portion of the top surface of first fin 146. A second radial line RL2 may extend from the rotational axis A to the trailing edge 134. As an example, the first radial line RL1 and the second radial line RL2 may form an angle defined by a chord length of blade tip section and blade tip radius. The chord length may refer to the distance between a leading edge point and a trailing edge point defined by a fan blade section. A blade section may refer to a cross sectional surface intersection between a blade and a cylindrical surface which has the same axis as the fan.

In one or more embodiments, the third leading edge 132 extends along the first angle A1 that may be oblique to either the first radial line RL1, the second radial line RL2, or both. In other words, the first angle A1 may be acute with respect to the first radial line RL1 that extends from and is perpendicular to the rotational axis A. This may help reduce drag or airflow resistance. In one or more embodiments the first angle A1 may be less than or equal to 70 degrees.

The trailing edge 134 of the second fin 126 may extend along the second radial line RL2. When the trailing edge 134 is defined by the second radial line RL2, the angle A2 is substantially equal to 0 degrees. In an alternative embodiment, the second radial line may extend through a portion of the second fin 126 and the trailing edge 134 of the second fin may extend along the second angle A2 so that the angle A2 is greater than 0 degrees. In other words, the second angle A2 may be acute with respect to the first or second radial lines RL1, RL2.

The second leading edge 128 of the first fin 124 may define the fourth angle A4 that may be oblique to either the first radial line RL1, the second radial line RL2, or both. The fourth angle that may be equal to or greater than the first angle A1 to reduce airflow resistance. As an example, the fourth angle A4 is less than or equal to 70 degrees with respect to the first radial line RL1 extending from and perpendicular to the rotational axis A.

Figure 6:
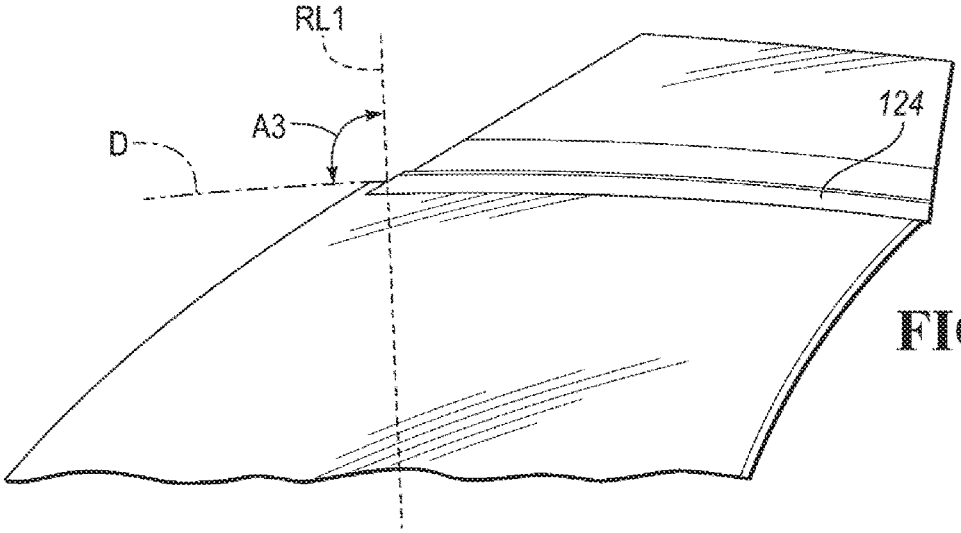
FIG. 6 is another detailed view of a portion of the exemplary fan blade and winglet illustrated in FIG. 4.

Referring to FIG. 6, a detailed view of a portion of the blade 112 is illustrated. As mentioned above, the first fin 124 may be curved or extend along a constant radius or diameter D.

Figure 7:
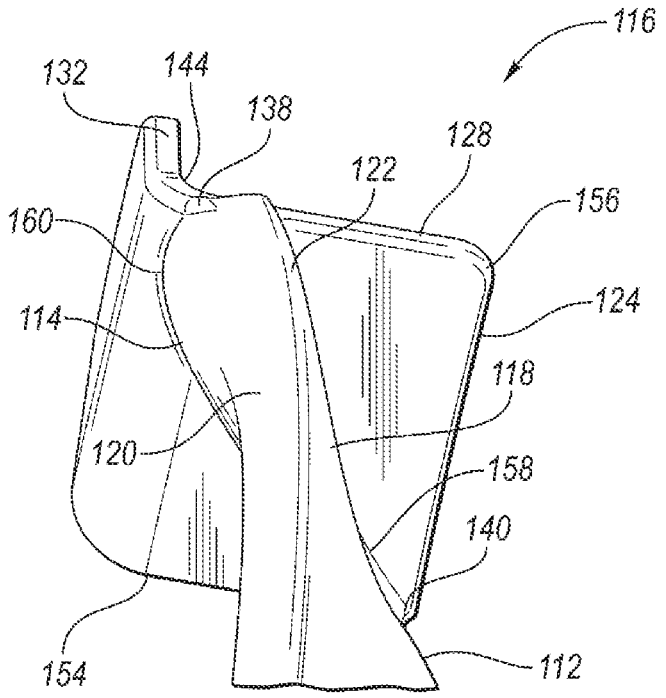
FIG. 7 is a partial-bottom-perspective view of the exemplary fan blade and winglet.

Referring to FIG. 7, a bottom-perspective view of the winglet 116 is illustrated. The first fin 124 may include a first corner 138 and a second corner 140 that may be positioned substantially diagonal to the first corner 138. A portion near of the distal end 114 of the blade 112 near the first leading edge 122 may extend to the first corner 138 and the rearward portion of the blade 112 may extend to the second corner 140. The first fin 124 may include a third corner 156 and a fourth corner 154. The third corner 156 may form the curved portion 150 and may be disposed on the first side 118 of the blade 112. The medial portion 144 may extend from the fourth corner 154 and the fourth corner 154 may be disposed on the second side 120 of the blade 112. As an example, a first portion 158 extending from a rear edge, opposite the leading edge 122, of the distal end 114 may extend from the second corner 140 to the medial portion 144. A second portion 160 of the distal end 114 may extend towards the second leading edge 128 and curve away from the medial portion 144.

Figure 8:
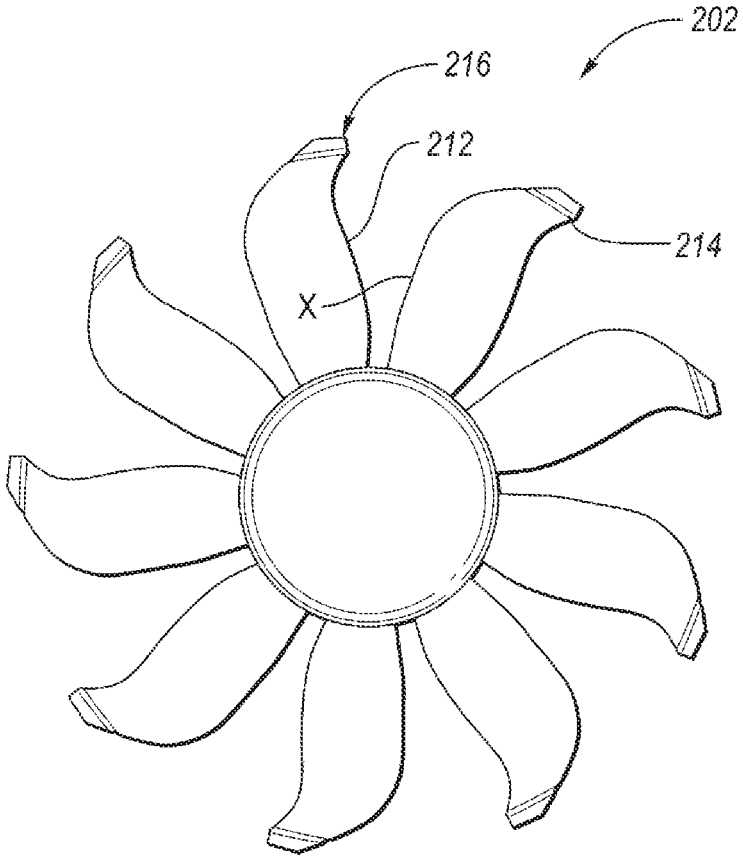
FIG. 8 is a plan view of an exemplary fan assembly provided with backward swept blades.

FIG. 8 illustrates a plan-view of another exemplary fan assembly 202 that includes a plurality of back swept blades 212. The back swept blade may refer to the shape of the blade 212 having a distal end 214 that lags with respect to a center of the blade, as indicated by reference element X as the fan assembly 202 rotates. Each of the straight blades 212 may include the winglet 216 as described above. In one or more embodiments, a straight blade (not shown) may be used.

Figure 9:
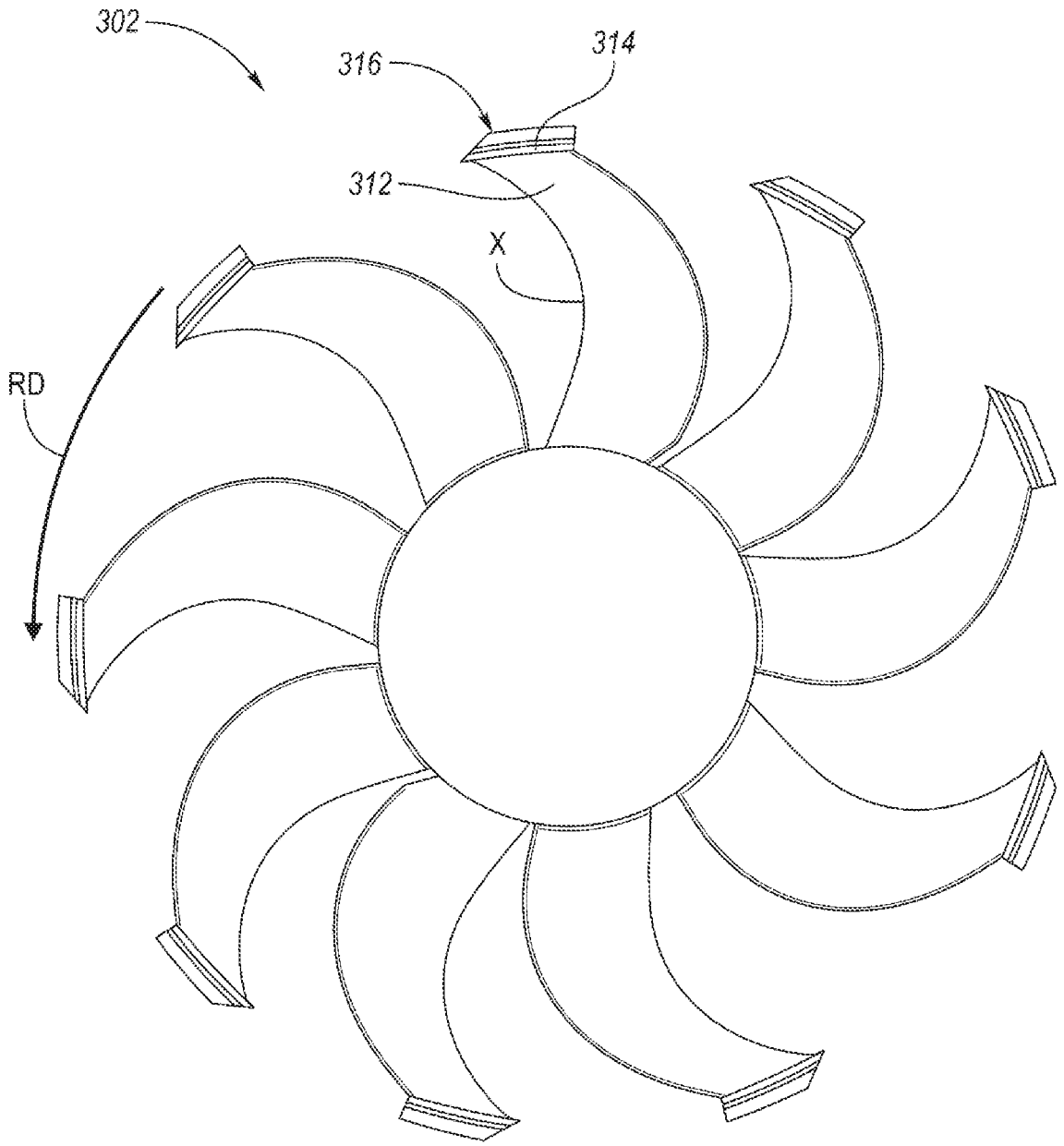
FIG. 9 is a plan view of an exemplary fan assembly provided with forward swept blades.

FIG. 9 illustrates a plan-view of another exemplary fan assembly 302 that includes a number of forward swept blades 312. The term "forward swept" may refer to the shape of the blade 312 having a distal end 314 that leads with respect to a center of the blade, as indicated by reference element X as the fan assembly 302 rotates. Each of the forward swept blades 312 may include another winglet 316.

Straight, forward and backward sweep blades may have different aerodynamic and acoustic characteristics. Exemplary geometrical characteristics of forward swept and back swept blades are provided in the '083 application.

Figure 10:
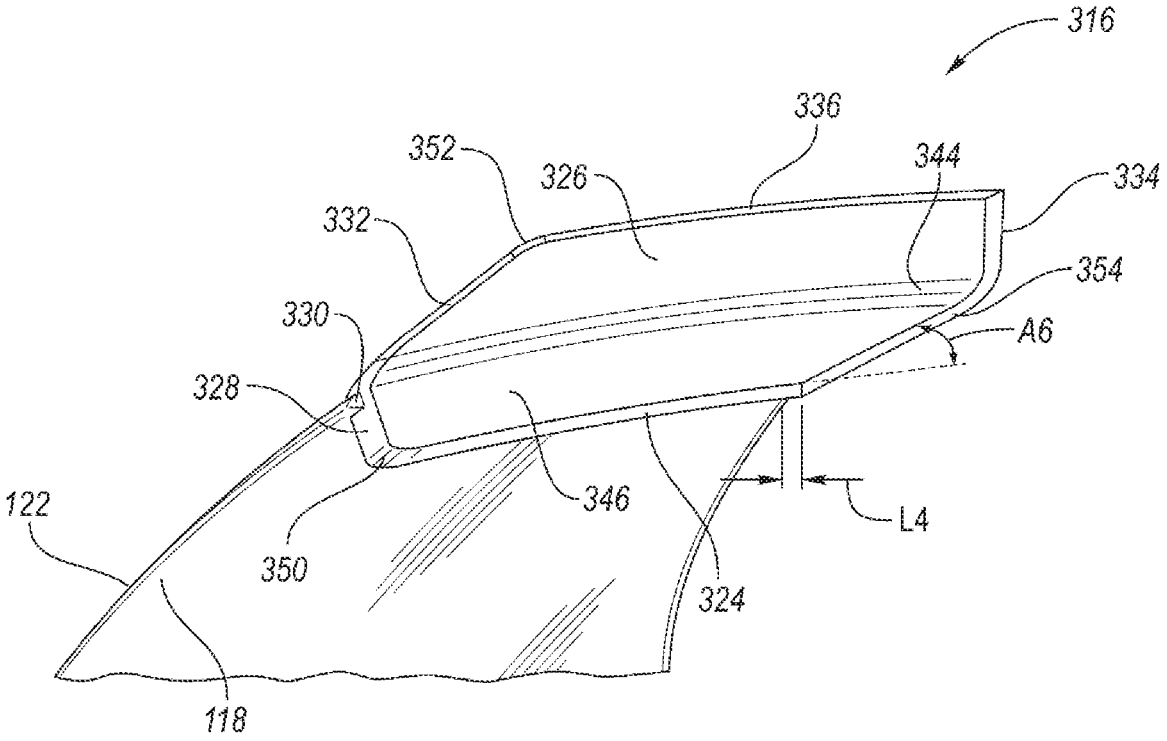
FIG. 10 is a partial-top-perspective view of the exemplary fan blade and winglet provided with a trailing edge variation.

Referring to FIG. 10 a top-perspective view of a portion of the back swept blade is illustrated. Because the fan shroud 104 and associated elements are identical to what has been provided above, those elements are not illustrated or described below. An exemplary winglet 316 is attached to the backward swept blade 112. The winglet 316 may include a first fin 324 and a second fin 326. The first fin 324 may extend in the axial direction so that it is substantially parallel to the second sidewall 142 of the shroud 104. The second fin 326 may extend in the radial direction so that it is substantially parallel to the first sidewall 106. A medial portion 344 may extend from the first fin 324 to the second fin 326, and the medial portion may be concave with respect to an inner periphery of the central opening.

A foremost portion of the first fin 324 includes a second leading edge 328 that may be angled with respect to the radial lines R1 and R2 (FIG. 4). The second leading edge 328 may be formed by an angled portion extending between a bottom surface 348 and a top surface 346 of the first fin 324. The second leading edge 128 may extend axially between a curved corner portion 350 and an exposed portion 330 that is formed by the distal end 314 at the first leading edge 122. Alternatively, the curved corner portion 350 may be part of the second leading edge 328.

Figure 11:
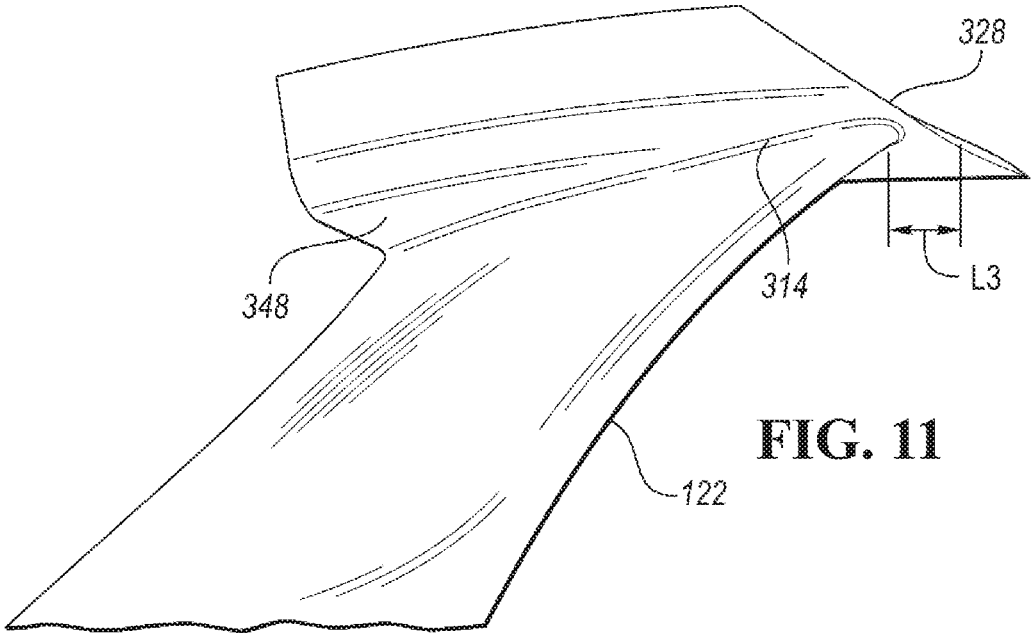
FIG. 11 is a partial-bottom-perspective view of the exemplary fan blade and winglet illustrated in FIG. 9.

Referring to FIG. 11, a bottom-perspective view of a portion of a straight or forward swept blade 312 is illustrated. Because the fan shroud 104 and associated elements are identical to what has been provided above, those elements are not illustrated or described below. An exemplary winglet 316 is attached to the forward swept blade 312. The winglet 316 may include the leading edge 328 that extends beyond a leading edge 122 of the blade 312.

For straight and forward swept fans, the leading edge 328 of the winglet 316 may cover the entire distal end of the fan blade to reduce airflow recirculation at the blade tip. A forward most portion of the second fin 326 and the medial portion 344 may form the third leading edge 332. The third leading edge 332 may extend to a distal edge portion 336 and the distal edge portion 336 may terminate at a trailing edge 334. As an example, a connecting portion 352 may extend between the distal edge portion 336 and the third leading edge. The connecting portion 352 may be curved to prevent airflow separation. The leading edge of the winglet may extend in the rotational direction past the leading edge 122 of the blade 312 by a distance L3. The distance L3 may range from 3 mm to 7 mm.

For forward swept, back swept, or straight fans, the trailing edge of winglet may be tapered to reduce recirculating flow. In one or more embodiments, the first fin 324 may be tapered between the second leading edge 328 and the trailing edge 334 of the second fin 326. As an example, the first fin 324 includes a second trailing edge 354 in a direction opposite the rotational direction by a distance L4. The distance L4 may range between 0.1 mm and 2 mm. In addition, the second trailing edge 354 may define an angle A6. The angle may range between 10° and 90°, so that a width of the first fin 324 decreases near the trailing edge 354.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

PARTS LIST

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

2 frame
6 fan ring
10 prior art cooling fan module
11 tip clearance gap
100 cooling fan module
102 fan assembly
104 fan shroud
106 first sidewall
108 central opening
108 opening
110 hub
112 blades
114 distal end
116 winglet
118 first side
120 second side
122 first leading edge
124 first fin
126 second fin
128 second leading edge
130 planar portion
130*a*, 130*b* connecting portions
132 third leading edge
134 trailing edge
136 distal edge
138 first corner
140 second corner
142 second sidewall
143 third sidewall
144 medial portion
145 axial extending wall
146 top portion first fin
148 bottom portion first fin
152 third corner
154 fourth corner
156 curved corner first fin
158 first portion of 114
160 second portion of 114
202 fan assembly
212 back swept blades
214 distal end
302 forward-swept fan assembly
312 forward swept blade
314 distal end
316 winglet
324 first fin
326 second fin
328 second leading edge
330 exposed portion
332 third leading edge
334 trailing edge
336 distal edge portion
344 medial portion
346 top surface
348 bottom surface
350 curved corner portion
352 connecting portion
354 second trailing edge
R Radiator
RD Rotational Direction
R1 Outer Radius Medial Portion
R2 Inner Radius Medial Portion L1 Length of Fin
L2 Length of Fin
L3 Length between leading edge of fin and leading edge of the blade
L4 Length between trailing edge of fin and trailing edge of blade
RL1 First Radial Line
RL2 Second Radial Line
A1-A6 Angles
D Diameter
X reference point
P surface
W1 width

What is claimed is:

1. A fan assembly, rotatable in a rotational direction about a rotational axis, for use in a vehicle cooling fan module including a fan shroud provided with a first sidewall extending in a radial direction defining an opening, the fan assembly comprising:

a hub disposed within the opening;

a blade extending from the hub to a distal end and including a first side and a second side converging to form a first leading edge with respect to the rotational direction; and a winglet including a first fin, extending in an axial direction from the distal end so that portions of the first fin are disposed on the first side and the second side of the blade, and a second fin extending in the radial direction, wherein the second fin includes a second leading edge and a trailing edge, each arranged with respect to the rotational direction, and a distal edge extending therebetween, wherein the second leading edge extends along a first angle oblique to a radial line extending from the rotational axis, and wherein the distal end of the blade includes a first portion and a second portion formed by a substantially planar surface extending between the first fin and the first leading edge and defining a second angle with respect to the radial line, wherein the second angle is substantially perpendicular to the radial line.

2. The fan assembly of claim 1, wherein the trailing edge extends along the radial line.

3. The fan assembly of claim 1, wherein the first fin includes a third leading edge arranged with respect to the rotational direction, wherein the third leading edge defines a fourth angle with respect to the radial line, wherein the fourth angle is equal to or greater than the first angle.

4. The fan assembly of claim 3, wherein the first fin has a length, extending in the axial direction and the second fin has a length extending in the radial direction wherein the length of the first fin is greater than the length of the second fin.

5. The fan assembly of claim 4, wherein the first fin includes a trailing edge and wherein the first fin is tapered between the third leading edge and the trailing edge.

6. The fan assembly of claim 1, wherein the second fin is configured to at least partially overlap an inner periphery of the opening with respect to the radial direction.

7. A cooling fan module comprising:

a frame provided with a first sidewall extending in a radial direction and defining a central opening; and a fan assembly disposed within the central opening and including, a hub, a blade extending from the hub to a distal end and including a first side and a second side converging to form a first leading edge, and a winglet including a first fin, extending in an axial direction from the distal end so that portions of the first fin are disposed on the first side and the second side of the blade, and a second fin extending in the radial direction, the first fin having a first corner and a second corner that is diagonal to the first corner, wherein the blade extends from the first corner to the second corner.

8. The cooling fan module of claim 7, wherein the second fin is spaced apart from the first sidewall in the axial direction.

9. The cooling fan module of claim 8, further comprising a second sidewall forming an inner periphery of the central opening and axially extending from the first sidewall, wherein the first fin at least partially overlaps the second sidewall in the axial direction.

10. The cooling fan module of claim 9, wherein the winglet includes a medial portion extending between the first fin and the second fin, wherein the medial portion is concave with respect to an inner periphery of the central opening.

11. The cooling fan module of claim 10, wherein the second fin at least partially overlaps the first sidewall with respect to the axial direction.

12. The cooling fan module of claim 10, wherein the second fin includes a distal edge and the second fin is tapered between the distal edge and the medial portion.

13. The fan assembly of claim 7, wherein the first fin extends in the rotational direction beyond the first leading edge of the blade.

14. A fan assembly, rotatable in a rotational direction about a rotational axis, for use in a vehicle cooling fan module including a fan shroud provided with a first sidewall extending in a radial direction defining an opening, the fan assembly comprising:

a hub disposed within the opening;

a blade extending from the hub to a distal end and including a first side and a second side converging to form a first leading edge with respect to the rotational direction; and a winglet including a first fin, extending in an axial direction and a second fin extending in the radial direction, wherein the first fin includes a second leading edge with respect to the rotational direction and a portion of the first leading edge, disposed at the distal end of the blade, extends beyond the second leading edge of the first fin, wherein the portion of the first leading edge lies within a common plane defined by a surface of the first fin.

15. The fan assembly of claim 14, wherein the shroud includes a second sidewall, a third sidewall, and a fourth sidewall, wherein the second sidewall and the fourth sidewall each extend in the axial direction and the third sidewall is disposed between the second sidewall and the fourth sidewall and extends in the radial direction, and wherein the first fin is configured to at least partially overlap the fourth sidewall with respect to the radial direction.

16. The fan assembly of claim 15, wherein the first fin is tapered in the rotational direction.

17. The fan assembly of claim 14, wherein the shroud includes a fifth sidewall extending from the fourth sidewall in the radial direction and wherein the first fin is configured to be substantially aligned with the fifth sidewall with respect to the axial direction.

* * * * *